US005562050A

United States Patent [19]

Colquhoun

[11] Patent Number: 5,562,050

[45] Date of Patent: Oct. 8, 1996

[54] COLLAPSIBLE ARTICLE OF FURNITURE

[76] Inventor: Ross M. Colquhoun, 9600 26th Ave. NW., Seattle, Wash. 98117

[21] Appl. No.: 391,759

[22] Filed: Feb. 21, 1995

[51] Int. Cl.[6] ..... A47B 3/00

[52] U.S. Cl. ..... 108/115; 108/149; 108/159; 312/258; 312/262; 248/454

[58] Field of Search ..... 108/115, 134, 108/135, 193, 149, 152, 154, 159, 175, 169, 128, 123; 312/258, 259, 262, 233, 231; 248/441.1, 454

[56] References Cited

U.S. PATENT DOCUMENTS

| | | | |
|---|---|---|---|
| 447,239 | 2/1891 | Babcock et al. | 312/262 |
| 472,907 | 4/1892 | Patton | 312/262 |
| 2,639,114 | 5/1953 | Allen | 312/258 X |
| 2,808,305 | 10/1957 | Jackson | 312/258 X |
| 3,124,085 | 3/1964 | Sanchez | 108/115 |
| 3,841,728 | 10/1974 | Petersen et al. | 108/159 X |
| 4,332,205 | 6/1982 | Corl, Jr. | 108/152 X |
| 4,686,910 | 8/1987 | Skjerseth | 108/118 X |
| 4,974,526 | 12/1990 | Wiygul, Jr. | 108/159 |
| 5,152,491 | 10/1992 | Forster et al. | 248/454 |
| 5,224,768 | 7/1993 | Vautier | 312/262 |
| 5,315,935 | 5/1994 | Weisenfels | 108/115 X |

FOREIGN PATENT DOCUMENTS

| | | | |
|---|---|---|---|
| 1126085 | 2/1953 | Germany | 108/157 |

*Primary Examiner*—Peter M. Cuomo
*Assistant Examiner*—Janet M. Wilkens
*Attorney, Agent, or Firm*—Bereskin & Parr

[57] ABSTRACT

An article of furniture such as a table, having four sides connected to each other by corner hinges. Two of the sides are each formed as two halves hinged together and normally rigidified by top rails, and by a horizontal work support panel located between the sides. When the work support panel is lifted and removed from the front, and the top rails are removed, the hinged sides can be folded inwardly so that the table frame assumes a relatively flat configuration. The front side of the table can be formed as two separate pieces, in which case the intermediate hinges in the sides can be removed. The table can also be made in a three-sided configuration, or in a bookshelf or cabinet configuration.

6 Claims, 8 Drawing Sheets

COLLAPSIBLE ARTICLE OF FURNITURE

FIELD OF THE INVENTION

This invention relates to a collapsible article of furniture, e.g. a table.

BACKGROUND OF THE INVENTION

Tables are commonly used for a wide range of purposes, for example as desks, computer tables, and for many other purposes. After they have been built, they normally occupy considerable floor space, and therefore it is costly to store a large number of assembled tables. In addition, many tables are sold to individual consumers, and it is often difficult for a consumer to transport a bulky table.

For the above reasons it has become common to sell tables in "knock-down" or kit form. These require the consumer to assemble the table, usually by screwing or attaching various parts together. It is common for the parts not to fit properly together, leading to considerable frustration on the part of the consumer. In addition, tables are often subjected to considerable stress, since commonly heavy weights (even the weight of a person) are placed on them, or they may be slid from one place to another while supporting heavy objects. Therefore, unless the assembly is very secure, which is difficult to achieve with a number of separate pieces, the table will begin to wobble in use and may even collapse under load. Also, much kit furniture tends to be of not particularly aesthetic appearance.

Therefore it is an object of the present invention to provide a collapsible article of furniture, such as a table, which occupies a relatively small amount of space when collapsed, and yet which can be erected in a simple manner, with minimal effort, to form a relatively sturdy article of pleasing appearance.

BRIEF SUMMARY OF THE INVENTION

In one of its aspects the present invention provides an article of furniture having:

(a) at least three side members, each side member having a pair of ends, (b) said ends of said side members each defining leg portions, said leg portions being connected together by substantially vertically extending corner hinges, (c) a work support member adapted to be received between at least some of said side members, and means for connecting said work support member to said side members so that when said work support member is so connected, said side members are prevented from folding about each other, (d) said side members being foldable about each other from an erected condition to a collapsed condition when said work support member has been removed.

In another aspect the invention provides a collapsible article of furniture having:

(a) first and second pairs of side members, each side member having a pair of ends, each end being adjacent and parallel to a corresponding end of an adjacent side member, (b) corner hinges mounted on said ends of each side member and connecting said side members together in a closed loop with the side members of each pair being opposed to each other, (c) the side members of said first pair having vertically extending intermediate hinges between their ends to allow said side members of said first pair to fold inwardly, said side members being moveable between an erected position in which each is substantially at right angles to its adjacent side members and said side members form a rectangle, and a collapsed position in which said side members of said first pair are folded inwardly and extend toward each other, and said side members of said second pair lie parallel to and closely adjacent to each other and are separated by the folds of said first pair, (d) a work support member adapted to fit between said first pair of side members when said side members are erected, (e) and means for removably attaching said work support member to at least some of said side members.

Further objects and advantages of the invention will appear from the following description, taken together with the accompanying drawings.

DETAILED DESCRIPTION OF PREFERRED EMBODIMENT

Figure 1:
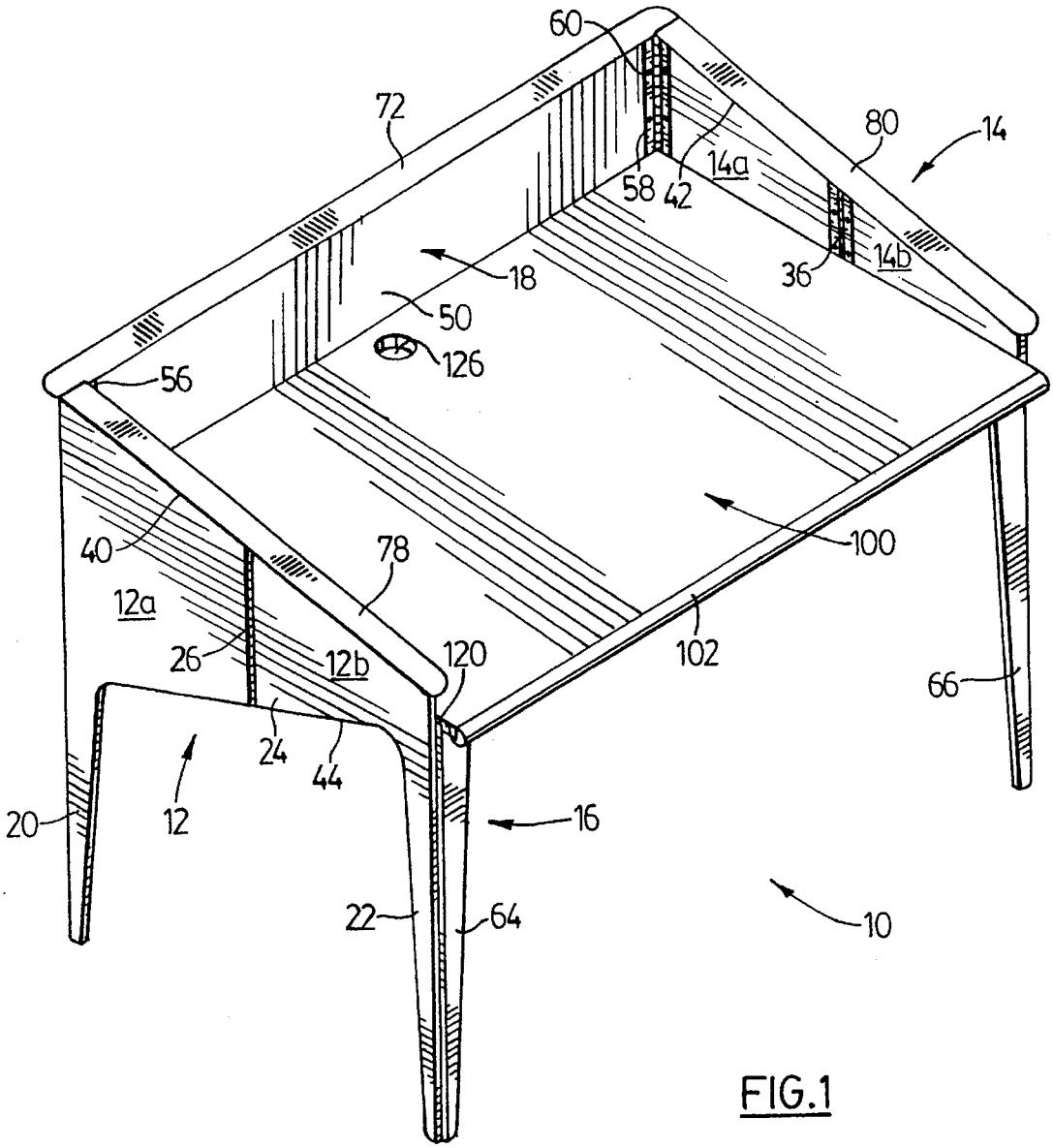
FIG. 1 is a front perspective view, from above, of an erected table according to the invention.
Figure 2:
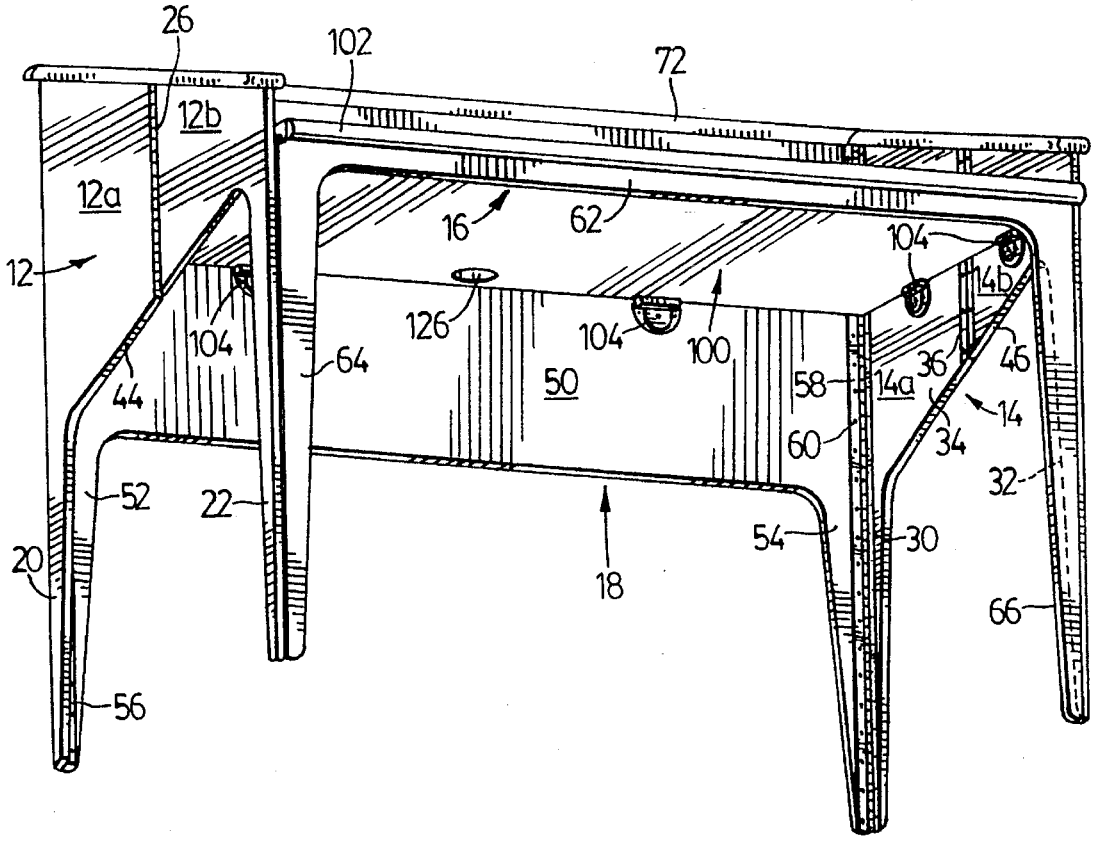
FIG. 2 is a front perspective view, from below, of the table of FIG. 1.

Reference is first made to FIGS. 1 to 5, which show a table 10 according to the invention, and in erected condition. The table 10 has side members 12, 14, a front member 16, and a rear member 18.

Side member 12 has a rear leg portion 20, a front leg portion 22, and a connecting portion or web 24 integrally connected to the leg portions 20, 22 and extending between the leg portions. The connecting portion 24 is divided at its center by a vertical piano hinge 26, thus dividing side member 12 into two halves 12*a*, 12*b* which can fold inwardly as shown in FIGS. 6 to 9.

Side member 14 similarly has rear and front leg portions 30, 32, a connecting portion 34, and a vertical piano hinge 36 dividing side member 14 into two halves 14*a*, 14*b*.

Figure 5:
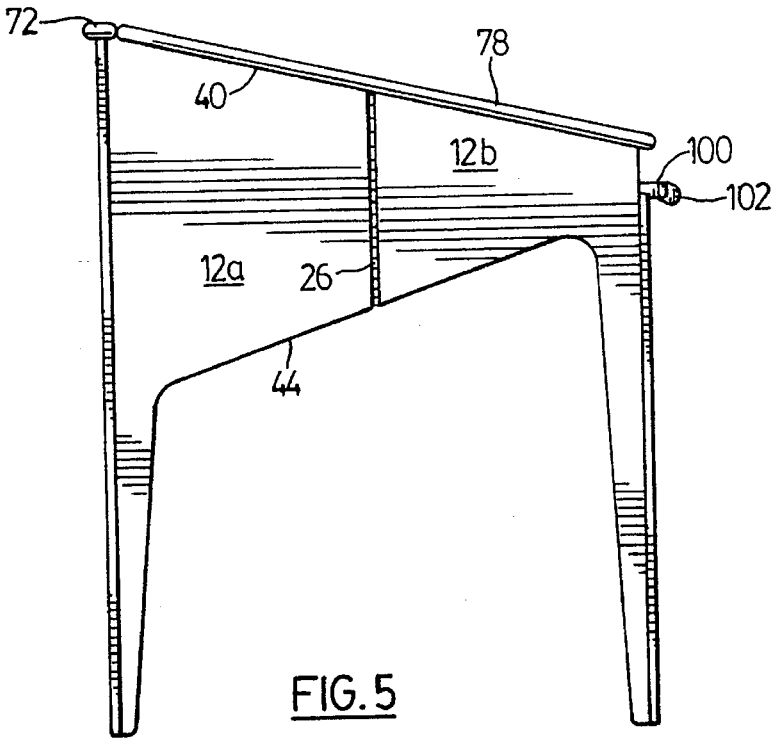
FIG. 5 is a side view of the table of FIG. 1.
Figure 3:
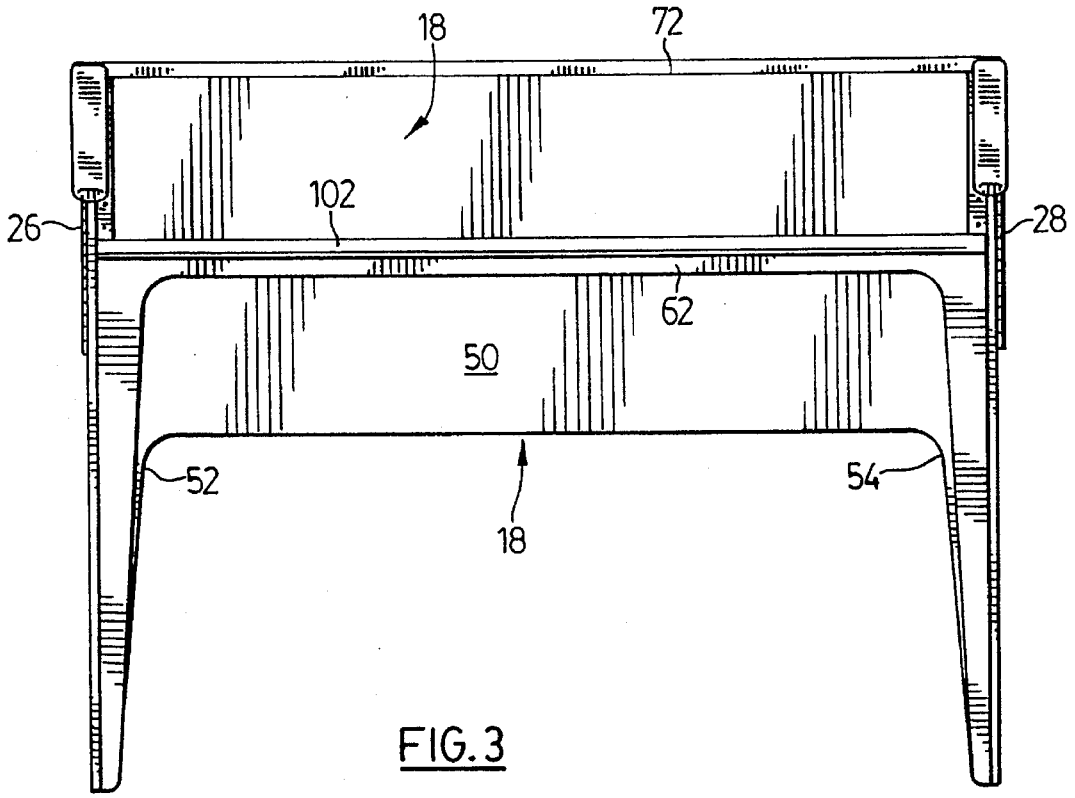
FIG. 3 is a front view of the table of FIG. 1.
Figure 4:
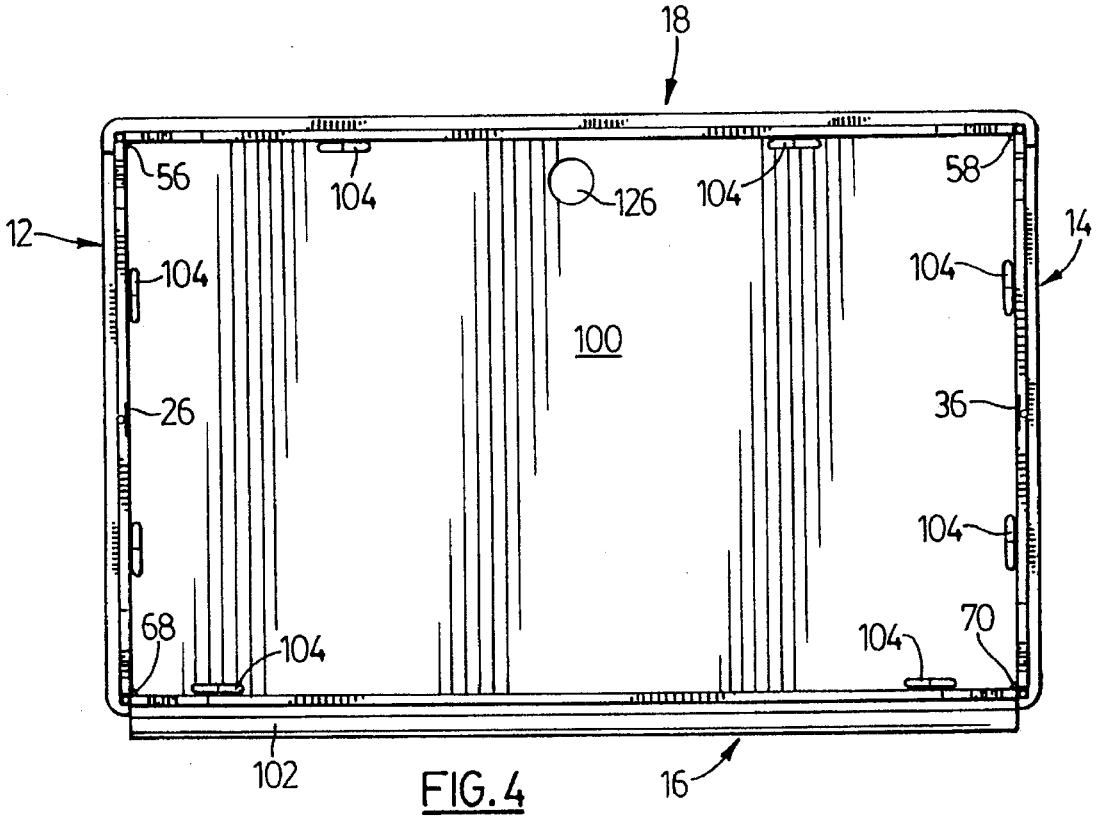
FIG. 4 is a bottom plan view of the table of FIG. 1.
Figure 6:
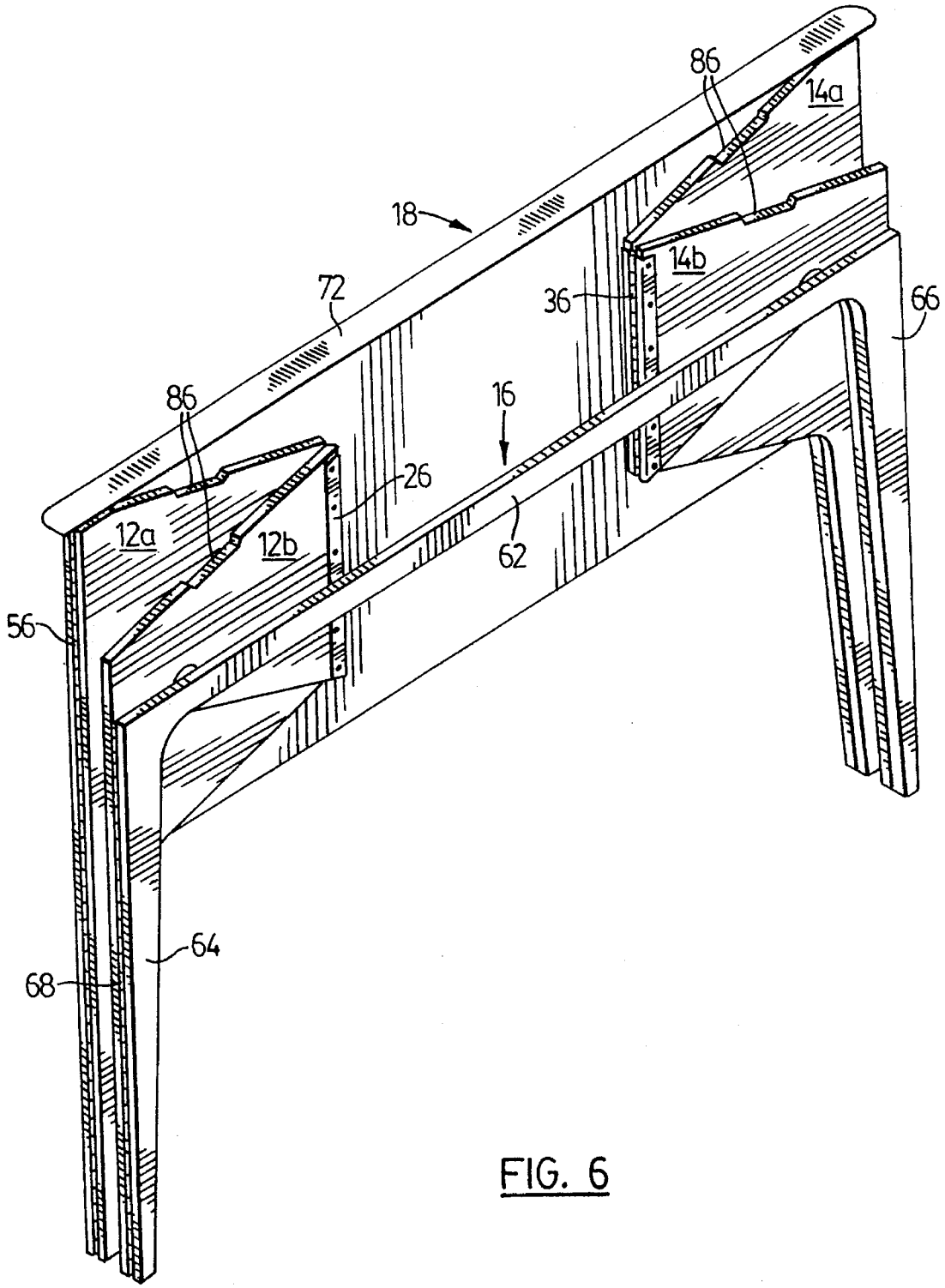
FIG. 6 is a front perspective view of the table of FIG. 1 in collapsed condition.
Figure 7:
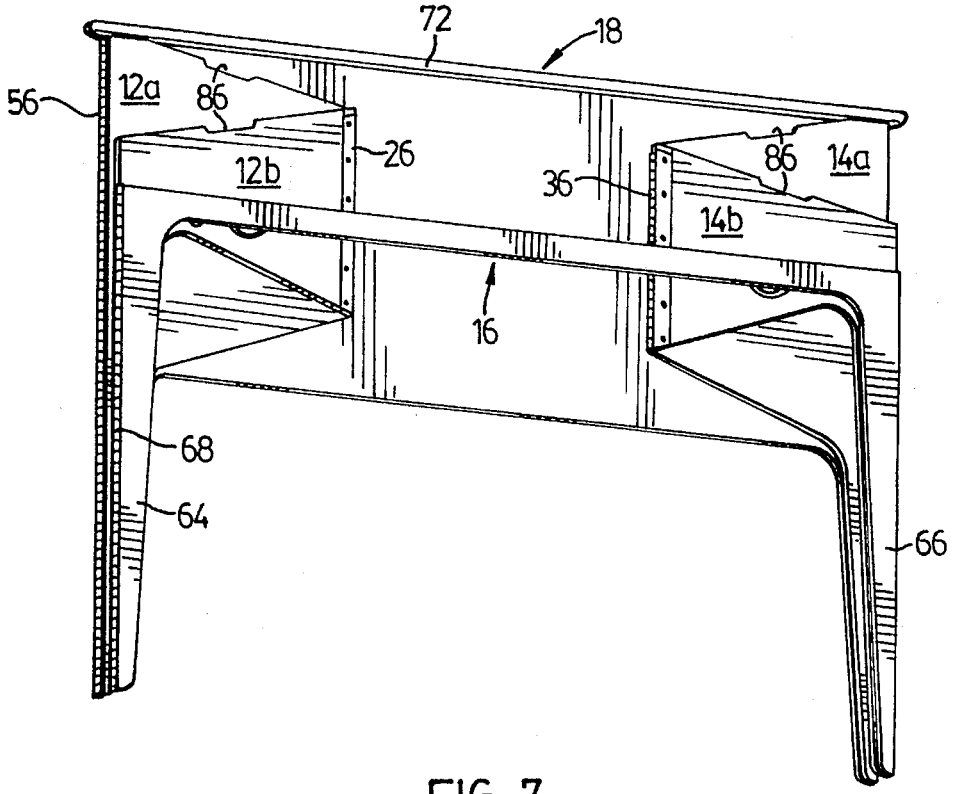
FIG. 7 is a perspective view, from the front and below, of the collapsed table of FIG. 6.
Figure 8:
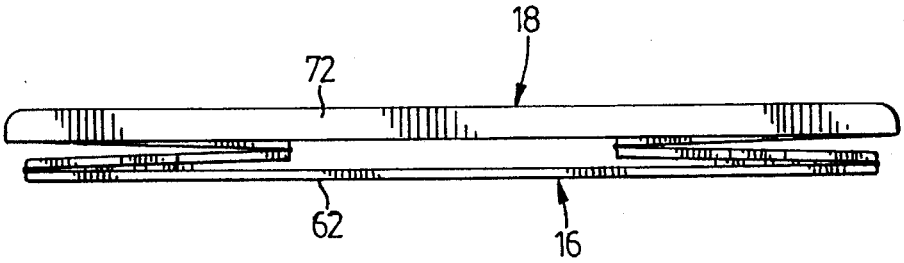
FIG. 8 is a top view of the collapsed table of FIG. 6.
Figure 9:
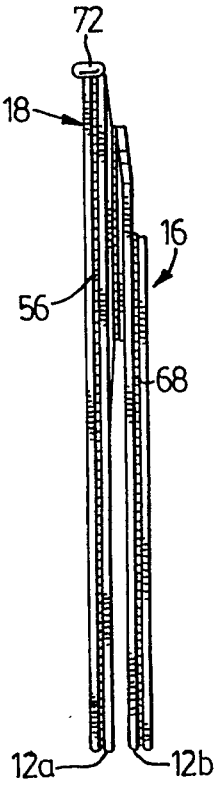
FIG. 9 is a side view of the collapsed table of FIG. 6.

In a preferred embodiment, and as best shown in FIG. 5, the top edges 40, 42 of each side member 12, 14 slope downwardly from rear to front, and the bottom edges 44, 46 slope upwardly from rear to front. Apart from the aesthetic advantages, this has the further advantage of reducing the mass in the front halves 12*b*, 14*b* of each side member while maximizing the length of the hinges 26, 36, thus increasing the strength of the hinged connection.

The rear member 18 includes a generally vertically oriented rectangular portion 50 having at its opposite sides downwardly extending leg portions 52, 54 which match in appearance the leg portions 20, 22, 30, 32 of the side members. The side edges of the rear member 18 (including those of its leg portions) are connected to the rear edges of the side members 12, 14 (including those of its leg portions) by corner piano hinges 56, 58. Hinges 56, 58 preferably extend substantially the full height of the rear member 18, and are connected to the rear and side members by screws 60. Again as shown in FIGS. 6 to 9, the hinges 56, 58 allow the side members 12, 14 to fold inwardly from the side edges of the rear member 18.

The front member 16 includes a thin cross support 62 extending between the front edges of the side members. A pair of front leg portions 64, 66 extend downwardly from opposite sides of the cross member 62 and again preferably match in appearance the leg portions 22, 32 at the fronts of the side members.

Like the rear leg portions, the leg portions 64,66 of the front member 16 are connected to the front leg portions 22, 32 of the side members 12, 14 by corner piano hinges 68, 70 which extend substantially the full height of the front leg portions 64, 66. This allows the front halves 12*b*, 14*b* of the side members to fold inwardly about the side edges of the front member 16.

The front, rear and side members can be made of various materials, but typically they are of plastic, fiberboard, particle board, plywood or the like.

Several different features are used to help rigidify the table 10 when it is erected. Firstly, a rigid rear bar or rail 72, e.g. of hardwood, is secured to the upper edge of the rear member 18. Preferably the rail 72 contains a groove (not shown) in its lower surface and is fitted over the upper edge of the rear member 18 and permanently secured there (e.g. by glue).

Secondly, rigid side bars or rails 78, 80, also grooved as indicated at 82 (FIG. 10), are typically slid onto the upper edges of the side members 12, 14. This will prevent the side members 12, 14 from folding inwardly after the table has been erected.

Figure 10:
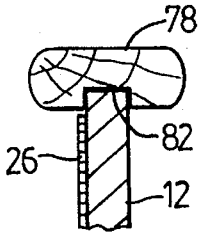
FIG. 10 is a sectional view of a side top rail in place on a side member.
Figure 11:
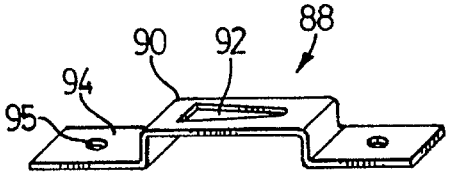
FIG. 11 is a perspective view of a fastener used in the FIG. 1 table.
Figure 12:
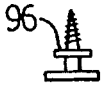
FIG. 12 is a side view of a collared screw used in the FIG. 1 table.

The side rails 78, 80 are preferably held in position as follows. As shown in FIGS. 6 to 9, recesses 86 are provided in the upper edges of each half side member 12*a*, 12*b*, 14*a*, 14*b*. The recesses 86 receive conventional generally U-shaped modular connectors 88 (FIG. 11) having a central portion 90 containing a tapered slot 92, and legs 94 containing openings 95 so that they can be screwed to the lower edges of the recesses 86. Conventional collared screws 96 (FIG. 12) are fastened to the undersides of the grooves 82 of rails 78, 80, over the connectors 88. In use, the grooves 82 of rails 78, 80 are placed over the upper edges of the side members 12, 14 with the heads of the screws 96 located in the widened portions of the slots 92. The rails 78, 80 are then slid into locked position. As shown in FIG. 10, the hinges 26, 36 terminate just below the tops of the side members 12, 14, so as not to interfere with rails 78, 80.

A third means of rigidifying the assembled table is provided by a work support member 100 (which forms a desk top). The work support member 100 is placed in the open frame constituted by the front, rear and side members after the open frame has been erected. The work support member 100 (which is normally generally horizontal) is again typically made of plywood, particle board, chip board or plastic and includes a front bar or rail 102 (e.g. of hardwood) permanently secured to its front edge (e.g. by glue) to help rigidify it.

The work support member 100 is typically held in position by eight fasteners indicated at 104, two mounted on each of the side, front and rear members 12, 14, 16, 18. Preferably the fasteners 104 are those sold under the trade mark "CAMLOCK". These fasteners, as is well known, consist of two parts 106, 108 (FIG. 13), one attached to each of the members to be secured together. The lower part 106, mounted on the front, rear and side members, each include a small projection 110 which when twisted (by a screwdriver inserted into slot 111) rotates through slots 112 and over a bar 113 of upper part 108 (mounted on the lower surface of the work support member 100), to lock the work support member 100 securely to the side and rear members.

Figure 13:
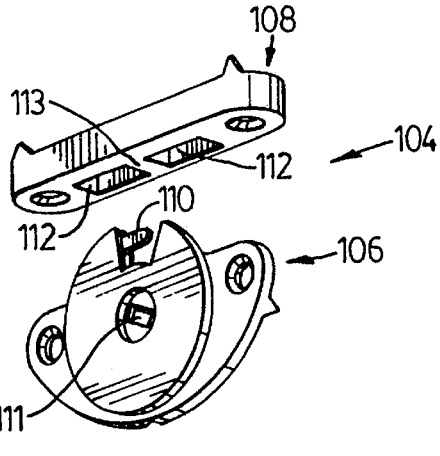
FIG. 13 is a perspective view of a conventional fastener used with the FIG. 1 table.
Figure 14:
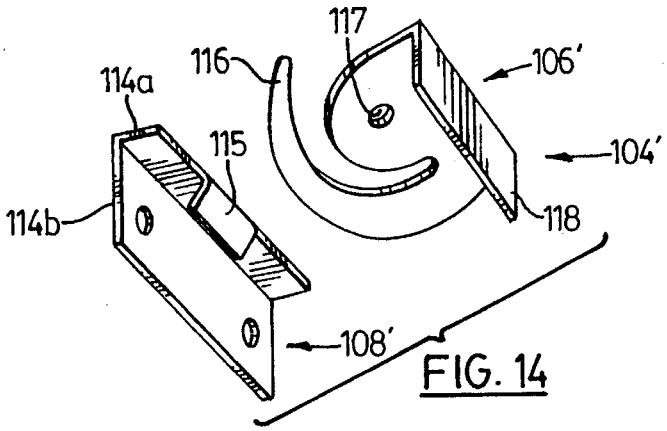
FIG. 14 is a perspective view of a modified fastener for use with the FIG. 1 table.

If desired, modified fasteners 104' may be used, as shown in FIG. 14 where primed reference numerals indicate parts corresponding to those of FIG. 13. In the fastener 104', part 108' is an L-shaped bracket containing legs 114*a*, 114*b*. The shorter leg 114*a* has an inwardly sloping tab 115 extending from its outer margin towards the other leg 114*b*. Part 106' contains a curved tooth 116 and is rotatably mounted on a surface (e.g. the front, rear and side members 12, 14, 16, 18) by a screw through hole 117 so that part 106' can be gripped and rotated by grip 118. When part 106' is rotated, tooth 116 moves into engagement with tab 115, locking the two parts together. With fastener 104', no tools are needed and also a larger tolerance is available in case the respective parts do not fit precisely together.

Figure 15A:
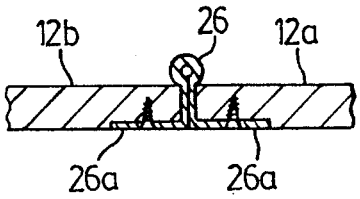
FIG. 15A is a sectional view of a piano hinge joining two halves of a side member in the FIG. 1 table.
Figure 15:
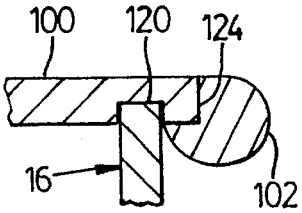
FIG. 15 is a sectional view of a work support member engaging a front member.

As an additional measure, and as shown in FIG. 15, the work support member 100 includes a groove 120 in its lower surface 122, extending parallel to the front edge 124 and spaced slightly rearwardly therefrom. As shown in FIGS. 1 and 15, the groove 120 accommodates the upper edge of the front member 16, helping to prevent the work support member 100 from sliding forwardly after it has been placed in position. Of course since the work support member is also held in position by the eight fasteners 104, it is securely held in place.

When the table 10 is erected it has the configuration shown in FIGS. 1 to 5. When it is to be collapsed, the fasteners 104 are unlocked and the work support member 100 is removed. The upper rails 78, 80 are then removed from the upper edges of the side members 12, 14. The side members 12, 14 are then folded inwardly as shown in FIGS. 6 to 9, so that the table assumes the configuration shown in those drawings. The fasteners 104 are located so that when the table is folded, the fasteners 104 do not fold inwardly onto each other. The table, with its work support member 100 and rails 78, 80, can then be stored and transported in a relatively thin carton. For example a table which when erected is 48 inches wide, 36 inches high and 30 inches deep can typically be collapsed to a configuration in which the depth is reduced from 30 inches to 4 inches. (The height and width remain unchanged.)

If desired the work support member 100 can include an opening 126 through which power cables, communication cables and the like may be passed.

When the table 10 is erected, it will be noted that the fasteners 104 are all located on the insides of the panels of the table, where they are not readily visible. The locking connectors 88 are fully hidden from view. The four corner hinges 56, 58, 68, 70 are all on inside surfaces and only the tops of the rear corner hinges 56, 58 are easily visible (the tops of the front corner hinges 68, 70 are covered by the work support member 100). The only hinges the full height of which will be visible on the exterior of the table are the intermediate piano hinges 26, 36, but when the table is erected, only the rounded outer edges of these hinges will be visible from the exterior of the table. The inside faces **26*a*, 26*b* of the hinges 26, 36 are countersunk into the side members 12, 14 (FIG. 15A), thus eliminating any interference with the work support member 100. The rear corner hinges 56, 58, may be similarly countersunk if desired. Countersinking is not normally necessary for the front corner hinges 68, 70 since they terminate just below the work support member 100**.

While a preferred embodiment has been shown, it will be realized that various changes can be made. For example if desired, the side members 12, 14 can be made rigid and hinges may be placed in the centers of the front and rear members 16, 18 (provided that the length of the folded in front and rear members are less than or equal to the length of the sides). However in such event, the height of the cross support 62 of the front member 16 should be increased sufficiently so that the hinged joint in the front member will be strong enough to support the loads to which the table is normally subjected. In addition, for example, other kinds of hinges can be used, e.g. continuous plastic hinges, and "living" hinges (which use a plastic membrane as the hinging member).

While the configuration shown is that of a table, the unit can also be made as a book shelf or accessory cabinet (e.g. for a printer or other computer equipment). In this case the side members 12, 14 would normally be generally rectangular and would extend from near the floor to their desired height, and the cross support 62 of the front member 16 would be at a lower height (near the floor) to support the first shelf of the book shelf or cabinet. The remaining shelves (there may e.g. be 2 or 3 shelves or more in total) of the book shelf or cabinet can be supported by conventional insert fasteners, of which many different kinds are commercially available. The side rails 78, 80 may still be used, or alternatively a top panel or sheet may be used, with grooves in its lower surface near its sides, to fit over the top of the side members 12, 14 to rigidify them in the same manner as the rails 78, 80 (and to retain them in parallel spaced position).

Figure 16:
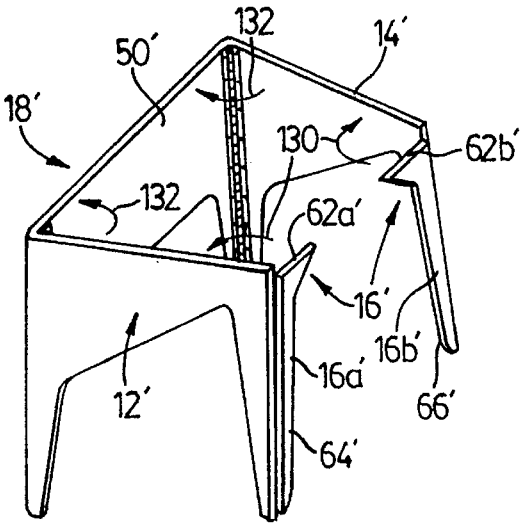
FIG. 16 is a perspective view of the assembled frame of a modification of the FIG. 1 table.
Figure 17:
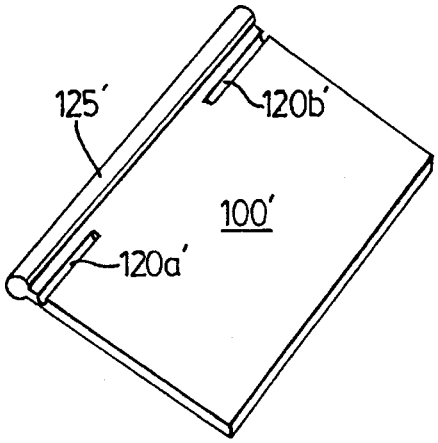
FIG. 17 is a perspective view of the lower surface of a work support member for the FIG. 16 table.

Reference is next made to FIGS. 16, 17, which show another embodiment of the invention. Primed reference numerals indicate parts corresponding to those of FIGS. 1 to 15. The side and rear rails have been omitted for simplicity. In the FIGS. 16, 17 embodiment, the side members 12', 14' do not contain central hinges but instead are solid. The front member 16' is formed as two separate portions **16*a'*, 16*b'*, each having a leg portion 64', 66' and an inwardly extending generally triangular upper portion 62*a'*, 62*b'*. The upper portions 62*a'*, 62*b'* are received in grooves 120*a'*, 120*b'* in the lower surface of the work support member 100' as shown in FIG. 17. (Two grooves are shown but one continuous groove could be used.) Conventional fasteners, such as fasteners 104, are used as before to lock the inwardly extending upper portions 62*a'*, 62*b'* to the work support member 100' when the table is erected. Two additional fasteners (not shown) hold the work support member 100' to each of the side and rear members 12', 14', 18'**.

The FIGS. 16, 17 version is collapsed by first removing the work support member 100'. Then the front member portions **16*a'*, 16*b'* are folded inwardly as indicated by arrows 130, and then the side members 12', 14' are folded inwardly as indicated by arrows 132**.

An advantage of the FIGS. 16, 17 version is that it is slightly simpler and less expensive to produce than the previously described embodiment. A disadvantage is that it is somewhat less strong than the previous version and can be slightly more difficult to assemble.

Figure 18:
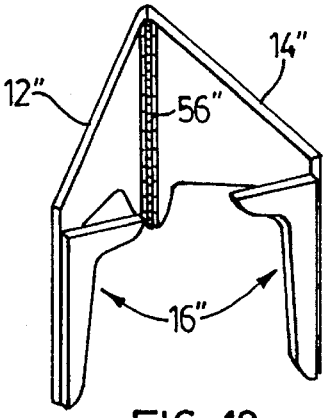
FIG. 18 is a perspective view of the assembled frame of a modification of the FIG. 16 table.
Figure 19:
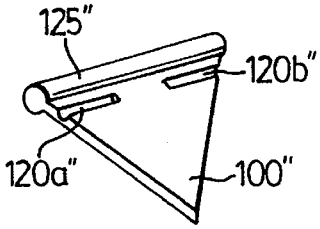
FIG. 19 is a perspective view of the lower surface of a work support member for the FIG. 18 table.

Reference is next made to FIGS. 18, 19, which show a further embodiment of the invention, and in which double primed reference numerals indicate parts corresponding to those of FIGS. 1 to 17. The FIGS. 18, 19 embodiment is exactly the same as that of FIGS. 16, 17, except that it is three sided. Thus, the rear member has been omitted and the side members 12", 14" connect to each other at hinge 56". The front member 16" is the same as in FIG. 16 and the work support member 100", although triangular, is installed in the same way as described for FIGS. 16, 17.

Figure 20:
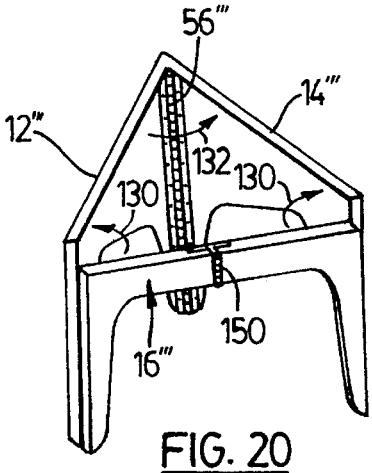
FIG. 20 is a perspective view of a modified frame for the FIG. 18 table.

If desired, and as shown in FIG. 20, where triple primed reference numerals indicate parts corresponding to those of FIGS. 1 to 19, the front member 16''' can extend across the entire front of the table 10''', with a hinge 150 at its center to allow it to fold inwardly. Table 10''' is collapsed by folding it (after removal of work support member 100''') in the direction of arrows 130''', 132'''.

Figure 21:
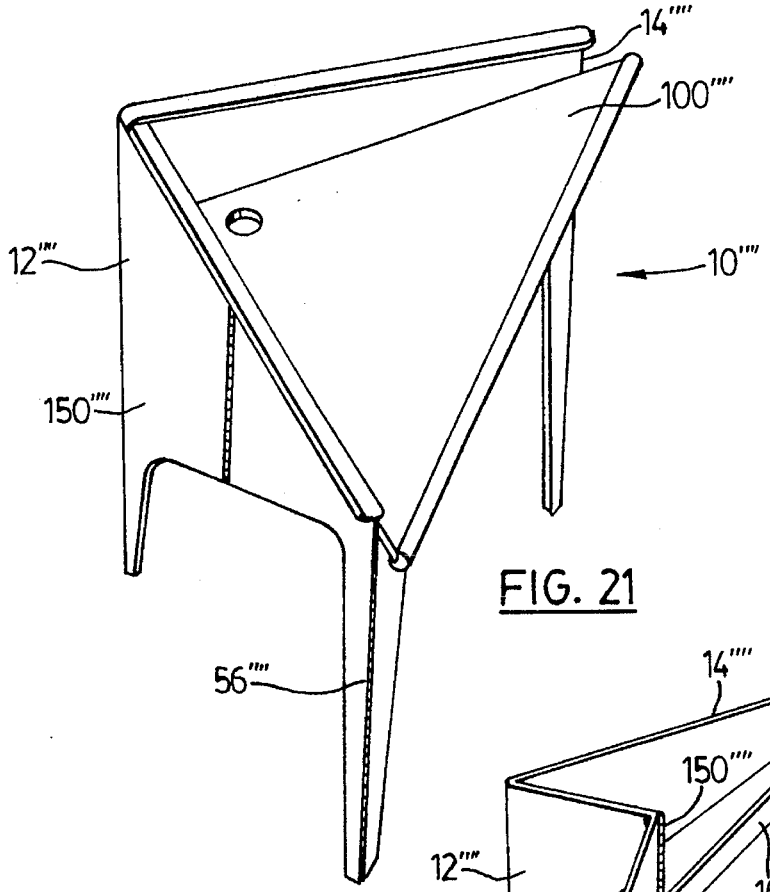
FIG. 21 is a perspective view of another modified table according to the invention.
Figure 22:
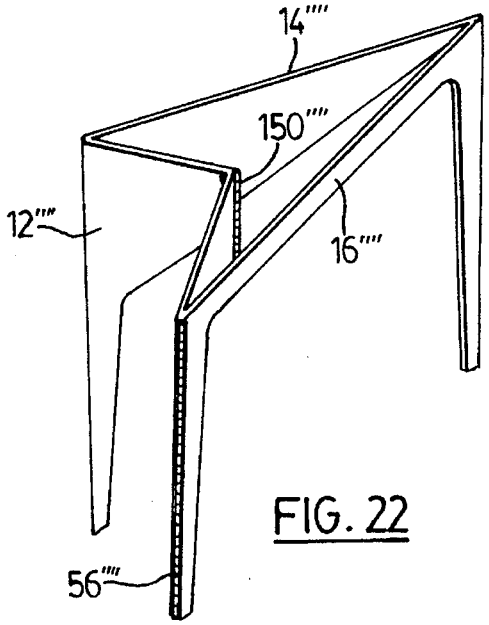
FIG. 22 is a perspective view of the FIG. 21 table, partly folded.
Figure 23:
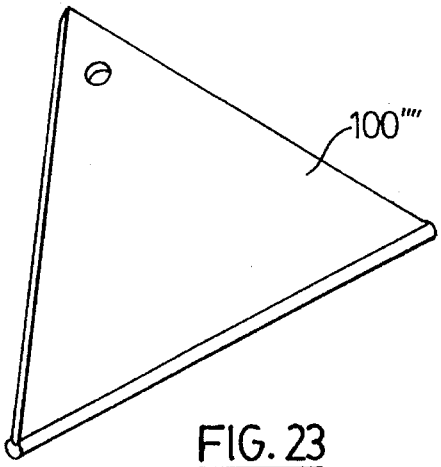
FIG. 23 is a perspective view of a top for the FIGS. 21 and 22 table.

Lastly, references made to FIGS. 21 to 23, where quadruply primed reference numerals indicate parts corresponding to the previous figures. The FIGS. 21 to 23 triangular table 10'''' is similar to that of FIG. 20, except that a piano hinge 150'''' is placed at the center of side 12'''', and corner piano hinges 56'''' are placed at each of the three corners. The work surface 100'''' is positioned and locks in place as previously described.

While preferred embodiments of the invention have been described, various other changes within the spirit of the invention may be made as desired.

I claim:

1. A collapsible table having:

(a) first and second pairs of side members, each side member having a pair of ends, each end being adjacent and parallel to a corresponding end of an adjacent side member, (b) corner hinges mounted on said ends of each side member and connecting said side members together in a closed loop with the side members of each pair being opposed to each other, (c) the side members of said first pair having vertically extending intermediate hinges between their ends to allow said side members of said first pair to fold inwardly, said side members being moveable between an erected position in which each is substantially at right angles to its adjacent side members and said side members form a rectangle, and a collapsed position in which said side members of said first pair are folded inwardly and extend toward each other, and said side members of said second pair lie parallel to and closely adjacent to each other and are separated by the folds of said first pair, (d) said side members of said second pair of being a front member and a back member, and said side members of said first pair being sides joining said front and back members, said front member having a central portion which is substantially less in vertical extent than said back member, (e) said sides and said front and rear members each including a pair of leg portions with a connecting portion extending between said leg portions, said sides thereby having front and rear leg portions, the leg portions of said front member being connected to said front leg portions of said sides by said corner hinges, the leg portions of said rear member being connected to said rear leg portions of said side members by said corner hinges, (f) said connecting portions of said sides being of decreased vertical extent adjacent said front leg portions than at said rear leg portions, (g) means for rigidifying said side members of said first pair when said article has been erected, (h) a work support member adapted to fit between said first pair of side members when said side members are erected, (i) and means for removably attaching said work support member to at least some of said side members.

2. A table according to claim 1 wherein said means for rigidifying includes a pair of rail members, one for each of said sides, each rail member having a lower surface having a groove therein, said sides having upper edges which are removably received in said grooves when said table is erected, to prevent inward folding of said side members when said table is erected.

3. A table according to claim 2 wherein said work support member has a lower surface having a front edge, and a groove in said lower surface extending parallel to said front edge, said front member having an upper edge which is removably received in said groove of said work support member when said table is erected, to prevent said work support member from sliding forwardly when said article is erected.

4. A table according to claim 1 wherein said sides have upper and lower edges, and wherein said upper edges of each side slopes downwardly from adjacent said rear leg portion to adjacent said front leg portion, and wherein said lower edges of each side slopes upwardly from adjacent said rear leg portion to adjacent said front leg portion.

5. A collapsible table having:

(a) first and second pairs of side members, each side member having a pair of ends, each end being adjacent and parallel to a corresponding end of an adjacent side member, (b) corner hinges mounted on said ends of each side member and connecting said side members together in a closed loop with the side members of each pair being opposed to each other, (c) the side members of said first pair having vertically extending intermediate hinges between their ends to allow said side members of said first pair to fold inwardly, said side members being moveable between an erected position in which each is substantially at right angles to its adjacent side members and said side members form a rectangle, and a collapsed position in which said side members of said first pair are folded inwardly and extend toward each other, and said side members of said second pair lie parallel to and closely adjacent to each other and are separated by the folds of said first pair, (d) said side members of said second pair of being a front member and a back member, and said side members of said first pair being sides joining said front and back members, said front member having a central portion which is substantially less in vertical extent than said back member, (e) said sides and said front and rear members each including a pair of leg portions with a connecting portion extending between said leg portions, said sides thereby having front and rear leg portions, the leg portions of said front member being connected to said front leg portions of said sides by said corner hinges, the leg portions of said rear member being connected to said rear leg portions of said side members by said corner hinges, (f) said connecting portions of said sides being of decreased vertical extent adjacent said front leg portions than at said rear leg portions, (g) means for rigidifying said side members of said first pair when said article has been erected, (h) a work support surface adapted to be connected to and supported by at least some of said side members when said side members are erected, (i) and means for removably attaching said work support member to at least said some of said side members.

6. A table according to claim 5 wherein said sides have upper and lower edges, and wherein said upper edges of each side slopes downwardly from adjacent said rear leg portion to adjacent said front leg portion, and wherein said lower edges of each side slopes upwardly from adjacent said rear leg portion to adjacent said front leg portion.

* * * * *